United States Patent [19]

Klemm

[11] Patent Number: 4,510,864

[45] Date of Patent: Apr. 16, 1985

[54] SCREEN PRINTING MACHINE

[76] Inventor: Gerhard Klemm, Am Rehwinkel 37, 4800 Bielefeld 1, Fed. Rep. of Germany

[21] Appl. No.: 575,452

[22] Filed: Jan. 31, 1984

Related U.S. Application Data

[63] Continuation of Ser. No. 344,782, Feb. 1, 1982, abandoned.

[30] Foreign Application Priority Data

Feb. 2, 1981 [DE] Fed. Rep. of Germany ..... 3103421

[51] Int. Cl.[3] ..... B41L 13/02

[52] U.S. Cl. ..... 101/123; 34/115; 101/129

[58] Field of Search ..... 101/123, 129; 34/115

[56] References Cited

U.S. PATENT DOCUMENTS

| | | | |
|---|---|---|---|
| 930,756 | 8/1909 | Howarth | 34/115 |
| 1,028,296 | 6/1912 | Sohier | 101/170 |
| 1,961,829 | 6/1934 | Rutkoskie | 101/366 |
| 1,978,715 | 10/1934 | Meisel | 101/228 |
| 2,022,635 | 11/1935 | Durham | 101/157 |
| 2,074,455 | 3/1937 | Carleton | 34/115 |
| 2,224,803 | 12/1940 | Standley | 34/115 |
| 2,396,946 | 3/1946 | Grupe | 101/170 |
| 2,462,376 | 2/1949 | Fleisher | 101/123 |
| 2,671,397 | 3/1954 | Gorbatenko | 101/228 |
| 2,969,733 | 1/1961 | Madsen | 101/228 |
| 3,036,927 | 5/1962 | Jerothe | 101/170 |
| 3,323,700 | 6/1967 | Epstein | 101/288 |
| 3,401,630 | 9/1968 | Goodrich | 101/228 |
| 3,499,233 | 3/1970 | Black | 101/123 |
| 3,751,204 | 8/1973 | Baker | 101/123 |
| 3,752,070 | 8/1973 | Jaffa | 101/123 |

FOREIGN PATENT DOCUMENTS

| | | | |
|---|---|---|---|
| 629422 | 9/1978 | U.S.S.R. | 34/115 |

*Primary Examiner*—Clyde I. Coughenour
*Attorney, Agent, or Firm*—Peter K. Kontler

[57] ABSTRACT

A screen printing machine has at least one printing station wherein rotary or flat screens are used. Downstream of the printing station, there is provided a heated continuously or discontinuously driven roller over the heated jacket of which the web is trained. The web preferably consists of impermeable material. The heated roller defines a drying path. A cooling unit is disposed downstream of the drying path and is preferably defined by a cooling roller which is connected to a cooling device. A web supplying roller is mounted at the inlet of the machine and a takeup roller is mounted downstream of the cooling unit. The transport of the web may be controlled during forward movement as well as during rearward movement. The machine is compact because the cooling unit and one of the web supplying and takeup rollers are disposed at a level below the printing station. During intermittent operation, the heated roller operates in two stages, with a main stage and a follow-up stage both controlled by a device for imprinting and reading passer markers.

11 Claims, 4 Drawing Figures

SCREEN PRINTING MACHINE

This application is a continuation, of application Ser. No. 344,782, filed Feb. 1, 1982 now abandoned.

BACKGROUND OF THE INVENTION

The invention relates to a screen printing machine having at least one printing station through which a web is fed, and a heated roller which is provided downstream of the printing station and over which the web is trained.

The novel screen printing machine can be used for printing on paper, foils or the like, that is, on impermeable webs; however, it can also be used for printing on textile materials. Screen printing machines of such type are known. DE-OS No. 23 32 153 discloses a printing machine for webs of textile material wherein a driven roller is provided for the web at the end of the machine. When printing on webs of textile material, they are normally fed into a steamer and are subsequently dried and convoluted. When printing on paper, foils or the like, the ink need not be fixed in the fibrous material but it is dried. For this purpose, the printed webs run along so-called drying paths and are convoluted in such drying paths or are further processed after a certain interval of time.

The establishment of drying paths or driers at the discharge end of a screen printing machine requires space and, in addition, web supplying and collecting rollers have to be associated with the drying paths.

SUMMARY OF THE INVENTION

The invention provides that the driven roller constitute a heated roller and that the jacket of such roller establish a drying path for the web.

This renders it possible to eliminate the customary drier and to use the driven roller as a drier during contact of its peripheral surface with the web. Such contact drying eliminates abrupt skin formation on the ink which had been applied at the screen printing station and thus allows for rapid drying of the ink. By applying heat from the uncoated side of the running web, the volatile ingredients are expelled from ink to the surface and are discharged into the surrounding air so that the drying times are very short.

Thus, the heated roller serves as a drying device for the running printed web, and such roller is provided upstream of the web supplying or collecting roller. The drying zone and hence also the contact drying surface of the heated roller should be very large. It has been found that it is advantageous to use at least one-fourth of the roller circumference, preferably one-half or more of the peripheral surface of the heated roller, as a means for contacting the freshly printed web.

The path of the web may also extend along the entire circumference of the heated roller.

A further advantageous feature of the invention resides in that a cooling path defined by a cooling plate or a cooling and deflecting roller is provided downstream of the heated roller. In this manner, one achieves that the liquid components of printing ink, which is of liquid consistency and thus cannot undergo an abrupt complete drying, are rapidly cooled down in the cooling path and allow for complete solidification of ink. The web can be wound in the next step.

Due to the large angle of contact between the web and the heated roller, the direction of movement of the web is reversed so that the machine can constitute a compact structure. Especially when the heated roller is contacted by the web along an arc of 180° or more, it is possible to position the cooling path as well as the web supplying and collecting rollers at a level below the screen printing station. This results in a compact structure which causes the web to travel substantially along a circular path from a web supplying roller upwardly to the screen printing station, over the heated roller and along the cooling path to a takeup roller which is positioned below the screen printing station. The web can run continuously or discontinuously, and one can operate with flat screens or with rotary screens.

Furthermore, an additional feature of the invention resides in that the heated roller constitutes a vacuum roller. In accordance with the teaching of applicant's DE-OS No. 28 12 099, such roller can be advanced by a first drive during a first pass of the web in dependency on the pattern or along limited advance paths, and during several passes of the web, that is, when ink was already applied before and the web has been warped due to the application of ink, it can be moved in two stages in that the main advance stage takes place along the largest portion of the path and that a given required additional advance is effected by means of a secondary control exactly adjusted to the passer marks or to the pattern.

Furthermore, and as already suggested by applicant in the German patent application No. P 30 23 678.3, it is possible to run the machine forwardly and backwards whereby a secondary drying takes place on the heated roller during the return movement.

BRIEF DESCRIPTION OF THE DRAWING

Several embodiments of the invention are shown in the drawing wherein.

DESCRIPTION OF THE PREFERRED EMBODIMENTS

Each Figure shows a screen printing machine with a printing station 2, that is, with a printing station operating with a flat screen. As already mentioned, other types of screen printing machines can be equipped with the novel device.

Figure 1:
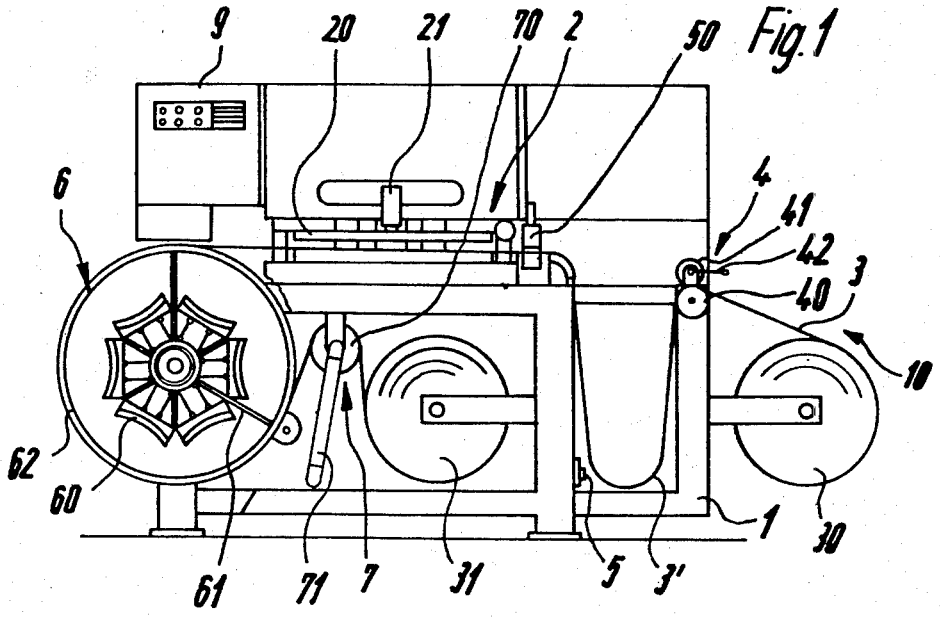
FIG. 1 shows the machine in a side elevational view.

The printing station 2 comprises a screen 20 and a reciprocating wiper device 21 and is mounted on a machine frame 1. FIG. 1 merely shows the head of the wiper device in a side elevational view. The web, preferably an impermeable web of paper, foil or the like, or if need be a web of textile material or a web of other fibrous material, is stored on a web supplying roller 30 at the inlet end 10 of the machine and is drawn off the roller 30 by a pair of advancing rollers 40 and 41 forming part of a web pulling device 4. The upper roller 41 of the pulling device 4 can be moved away, for example in that it is eccentrically mounted, by pivoting a lever 42 so that the upper roller 41 and the lower roller 40 bear against each other when the lever 42 is in the position which is shown in FIG. 1. Lifting of the upper roller 41 by pivoting the lever 42 is attributable to eccentric mounting of such upper roller.

That portion of the web 3 which moved beyond the advancing rollers 40, 41 forms a loop 3' whose length is monitored, for example, by a light barrier 5 which is associated with the loop control. Downstream of the loop 3', the web 3 enters the printing station 2 which, as already mentioned above, can be of any suitable design.

The roller 6 constitutes a rotary web heating and drying device and is located downstream of the printing station 2 and has a relatively large diameter. This roller is provided with an internal heater 60, for example, radiators as illustrated in FIG. 1, heating rods provided in the roller jacket, or the like.

Figure 4:
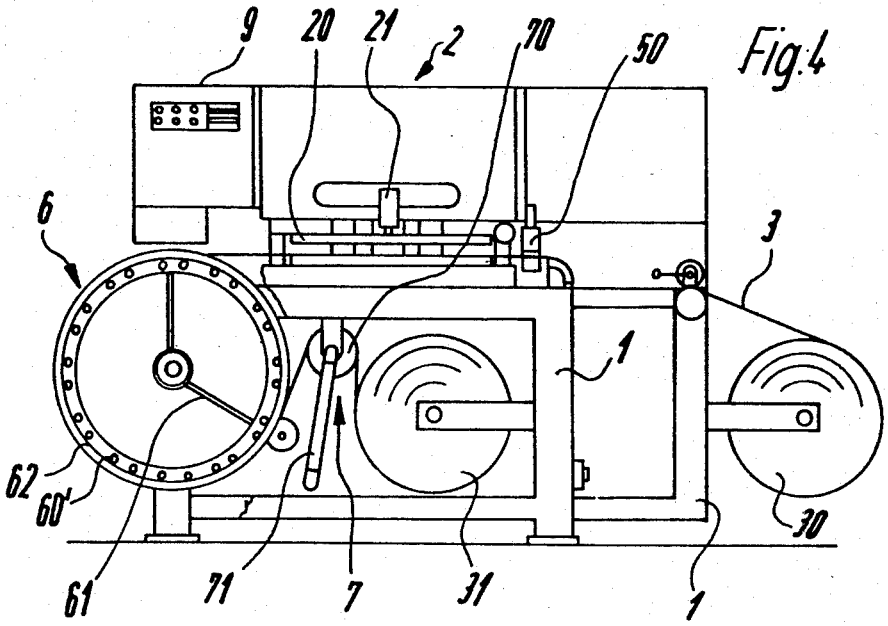
FIG. 4 shows a second embodiment of the machine.

The roller 6 may constitute a vacuum roller and supports in its interior a stationary vacuum chamber bounded by walls 61. That part of the roller 6 which is contacted by the moving web 3 is under vacuum. The walls 61 are stationary, the same as the heater 60. However, the jacket 62 of the roller 6 is driven. In the embodiment of FIG. 4, the roller jacket 62 rotates with the heating rods 60'. Such rotating heating elements are supplied with current through slip rings and carbon brushes in a known manner.

In the illustrated embodiments, the web 3 engages the jacket 62 of the roller 6 along an arc of 250°. The arc is at least 180° so as to achieve a sufficient heating interval. The suction chamber is connected to a suction generating device 63 whose suction pipe 163 supports the drive 64 for the heated roller 6. Such drive is connected with the jacket 62.

A cooling unit 7 is provided downstream of the heated roller 6. In the illustrated embodiments, this cooling unit comprises a cooling roller 70 having an inlet and an outlet for the cooling medium with rotating connections, which are also commercially available, through a supply line 71 (FIG. 2) and a discharge line 72. Both lines are connected to a cooling device 73.

Downstream of the cooling unit 7, there is provided a roller 31 which normally acts as a takeup roller. There is a possibility to have the web 3 move rearwardly towards the roller 30 which is positioned at the inlet 10 and then acts as a takeup roller. During printing, the roller 30 is the web supplying roller and the roller 31 is the takeup roller.

The web advancing action of the roller 6 can be carried out in two stages, as described in applicant's German patent application No. P 28 12 099.2. For example, the motor 164 may be controlled digitally as disclosed in applicant's German patent application No. P 29 43 894.6. In such instance, a light barrier or any other given reading device controls the correcting advance of the web.

During the first pass, the material of the web 3 is not deformed as yet; it is fed at regular intervals and, during printing, passer marks are applied by the device 50. Subsequently, the material of the web is dried by the heated roller 6 and is cooled by the cooling unit 7 which latter may comprise cooling plates, and the web is thereupon wound onto the takeup roller 31. Subsequently, the machine can be set for return movement of the web as described in applicant's German patent application No. P 30 23 678. The roller 30 is then the takeup roller and, during a renewed forward transport, the increments of advance are first shortened and a correcting advance takes place to the given passer mark. The motor 131 for the takeup roller 31 and the transmission and coupling unit 231 for this roller, as well as the motor 130 and the transmission and coupling unit 230 for the web supplying roller 30 are electrically connected with each other and are controlled by components in a switch box 8 which perform the overall control including the control of the advancing rollers 40, 41. Also, the signal from the light barrier 5 is fed into this control box, and the latter also contains components which regulate the operation of the drive 64 or the control of the motor 164 for the heated roller 6.

Figure 2:
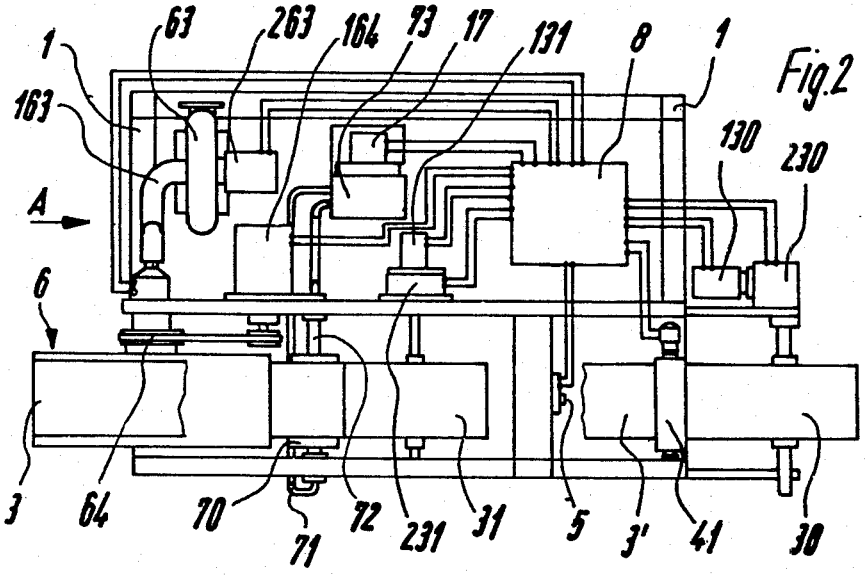
FIG. 2 shows the machine of FIG. 1 in a plan view.

FIG. 2 is a plan view of the machine and shows the electrical conductors. Here, it can also be seen that the suction generating device 63 is controlled by signals from the switch box 8.

However, the printing station 2 is controlled by an electric control unit 9 which is electrically connected with the switch box 8. The printing station 2 preferably influences the pull of the heated roller 6 by way of the electric control unit 9.

FIG. 1 shows an embodiment wherein the heated roller 6 is provided with radiators.

FIG. 2 illustrates the machine of FIG. 1 with the printing station 2 omitted. It further shows the electrical connections, the drive elements for the individual parts, the suction generating device 63 with its motor 263, the motor 164 for the drive 64 of the roller 6, the cooling device 73 with motor 173 for the cooling roller 70, the motor 131 and transmission-coupling unit 231 for the roller 31, as well as the motor 130 and transmission and coupling unit 230 for the roller 30.

Figure 3:
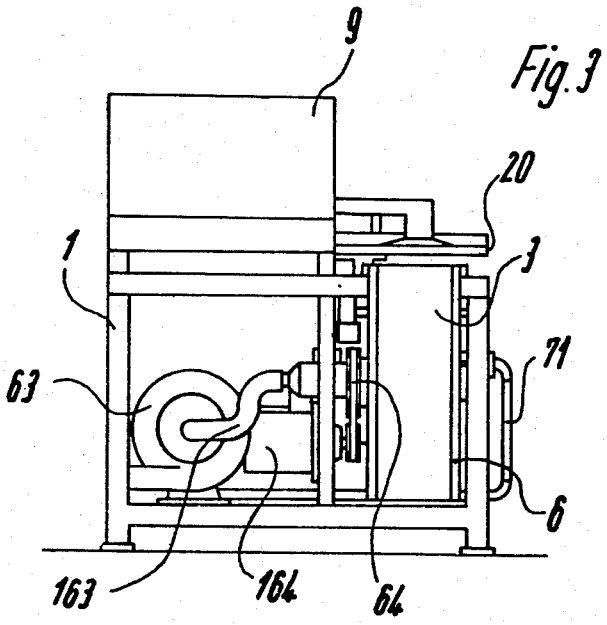
FIG. 3 shows the machine of FIGS. 1 and 2 in an end elevational view.

FIG. 3 is a view as seen in the direction of arrow in FIG. 2.

The embodiment of FIG. 4 differs from the embodiment of FIG. 1, among others, in that the heating rods 60' rotate with the jacket 62 of the roller 6.

The machine can operate continuously but is designed to operate essentially intermittently. The heated roller 6 can be designed as a vacuum roller, as shown in the drawing. If it is not designed as a vacuum roller, the walls 61 are omitted as well as the suction chamber with appurtenant equipment.

The regulation of several passes of the web 3 is carried out by the device 50 for imprinting the passer markers or by the device which reads such markers. Therefore, the passer markers can be applied together with the print, that is, during first application of ink, but also by a different device. This is actually known. During the second and renewed passes of the web, the passer markers are reached by the follow-up control of the web transport. This is made possible by the known device 50 which applies and reads the passer markers.

There is also the possibility to provide two or more ink lines in the machine, that is, not only one printing station but rather a plurality of printing stations. An advantage of the novel machine is its space-saving design in that the web advancing means also constitutes a drier. Large-area contact between the web and the roller 6 is made possible in that the direction of movement of the web is reversed. It is not necessary to print the entire web and then return it, but rather it is possible to operate in small increments, i.e., to make a few advances and print with one ink, to thereupon return the web, to apply the pattern in a different ink again in such small increments, etc., until a multicolor print is obtained. This renders it possible to operate very economically. By mounting the parts at different levels, namely the printing station 2 above the cooling station and the takeup station and such mounting of the relatively large heated roller which takes up the full height of such space as to provide a large heating path which is required for drying of the ink, it is possible to assemble a compact structure so that the machine takes up very little space.

I claim:

1. A screen printing machine of the type wherein a flexible web, particularly an impermeable web of paper or the like, is arranged to move forwardly and rearwardly along an elongated path, comprising a printing station having means for applying ink to one side of the web in a first portion of the path while the web moves forwardly; a driven rotary ink heating and drying device having a peripheral surface arranged to contact the other side of the web in a second portion of said path downstream of the first portion, as considered in the direction of forward movement of the web, said device having a permeable jacket and a stationary suction chamber disposed within the confines of said jacket and arranged to attract the web to said jacket along an arc of at least 90°; and means for moving the web forwardly and rearwardly to gain added printing time for repeated application of ink to the web, always while the latter moves forwardly, including rotary takeup means for collecting the dried web in a third portion of the path downstream of the second portion, as considered in the direction of forward movement of the web.

2. The machine of claim 1, wherein said moving means comprises means for intermittently driving said takeup means.

3. The machine of claim 1, wherein said device comprises rotary heating means.

4. The machine of claim 1, wherein said device comprises stationary heating means.

5. The machine of claim 1, further comprising means for cooling the web in a fourth portion of the path between the second and third portions.

6. The machine of claim 5, wherein said cooling means comprises a web-contacting roller and a device for cooling said roller.

7. The machine of claim 1, wherein the second portion of the path is arcuate so that the web reverses the direction of its movement as a result of engagement with said device.

8. The machine of claim 1, wherein said moving means comprises means for intermittently driving said takeup means in a direction to collect the web so that each intermittent movement of the web involves a first stage and a second stage, and further comprising means for applying to the web markers as well as for regulating said driving means in dependency on the positions of the applied markers.

9. The machine of claim 1, further comprising rotary web supplying means arranged to admit the web into a fourth portion of the path upstream of the first portion, said printing station being disposed at a level above said takeup means and said web supplying means and the latter being adjacent to said takeup means.

10. A screen printing machine of the type wherein a flexible web, particularly an impermeable web of paper or the like, is arranged to move forwardly and rearwardly along an elongated path, comprising a printing station having means for applying ink to one side of the web in a first portion of the path while the web moves forwardly; a driven rotary ink heating and drying device having a peripheral surface arranged to contact the other side of the web in a second portion of said path downstream of the first portion, as considered in the direction of forward movement of the web; and means for moving the web forwardly and rearwardly to gain added printing time for repeated application of ink to the web, always while the latter moves forwardly, including rotary takeup means for collecting the dried web in a third portion of said path downstream of said second portion, as considered in the direction of forward movement of the web, and rotary web supplying means arranged to admit the web into a fourth portion of the path upstream of the first portion, as considered in the direction of forward movement of the web, said moving means including means for rotating said takeup means and said web supplying means clockwise and counterclockwise so that the takeup means pays out the web when the web supplying means is driven in a direction to collect the web and vice versa.

11. The machine of claim 1, wherein the peripheral surface of said device is arranged to contact the other side of the web along an arc of at least 90°.

* * * * *